US008960098B2

(12) United States Patent
Boren et al.

(10) Patent No.: US 8,960,098 B2
(45) Date of Patent: Feb. 24, 2015

(54) TROLLEY BRAKING SYSTEM

(71) Applicants: Daniel Blair Boren, Pukalani, HI (US); Mira De Avila-Shin, Oakland, CA (US); David B. Golay, Seattle, WA (US); Nickolaus W. Hill, Long Beach, CA (US); Samuel D. Meyer, San Diego, CA (US); Ilona K. Phipps-Morgan, San Diego, CA (US)

(72) Inventors: Daniel Blair Boren, Pukalani, HI (US); Mira De Avila-Shin, Oakland, CA (US); David B. Golay, Seattle, WA (US); Nickolaus W. Hill, Long Beach, CA (US); Samuel D. Meyer, San Diego, CA (US); Ilona K. Phipps-Morgan, San Diego, CA (US)

( * ) Notice: Subject to any disclaimer, the term of this patent is extended or adjusted under 35 U.S.C. 154(b) by 172 days.

(21) Appl. No.: 13/792,133

(22) Filed: Mar. 10, 2013

(65) Prior Publication Data

US 2013/0239843 A1 Sep. 19, 2013

Related U.S. Application Data

(63) Continuation-in-part of application No. 13/419,239, filed on Mar. 13, 2012, now Pat. No. 8,783,190.

(51) Int. Cl.
*B61B 12/00* (2006.01)
*A63G 21/20* (2006.01)
*B61B 7/00* (2006.01)

(52) U.S. Cl.
CPC ..... *B61B 12/00* (2013.01); *A63G 21/20* (2013.01); *B61B 7/00* (2013.01)
USPC ..... 104/117.1

(58) Field of Classification Search
CPC ..... A63G 21/20; A63G 21/22; B61B 7/00; B61B 12/00
USPC ..... 104/117.1; 188/290
See application file for complete search history.

(56) References Cited

U.S. PATENT DOCUMENTS

| | | | | | |
|---|---|---|---|---|---|
| 201,050 | A | * | 3/1878 | Root | 182/233 |
| 268,641 | A | * | 12/1882 | Dittmar et al. | 188/268 |
| 289,318 | A | * | 11/1883 | Smith | 182/237 |
| 295,047 | A | * | 3/1884 | Parrott | 182/236 |
| 319,888 | A | * | 6/1885 | Dittrick | 182/236 |
| 326,726 | A | * | 9/1885 | Dittrick | 182/238 |
| 361,580 | A | * | 4/1887 | Dittrick | 182/238 |
| 547,528 | A | | 10/1895 | Weaver et al. | |
| 575,528 | A | | 1/1897 | Smallwood | |
| 1,047,948 | A | * | 12/1912 | Karminski et al. | 60/354 |
| 1,087,063 | A | | 2/1914 | Izett | |
| 1,206,581 | A | | 11/1916 | Opsal | |
| 1,228,215 | A | * | 5/1917 | Junkers | 188/290 |
| 1,701,007 | A | * | 2/1929 | Libani | 188/290 |
| 2,363,821 | A | * | 11/1944 | Webster | 188/290 |
| 3,070,035 | A | | 12/1962 | Russo et al. | |
| 3,192,872 | A | | 7/1965 | Parent | |
| 4,934,277 | A | | 6/1990 | Smith et al. | |
| 4,948,118 | A | | 8/1990 | Miraglia | |

(Continued)

*Primary Examiner* — Zachary Kuhfuss
(74) *Attorney, Agent, or Firm* — Bryan Cave LLP

(57) ABSTRACT

A trolley braking system for smoothly reducing the speed of a rider supported by a harness on a cable or rope approaching a landing platform comprises a vessel containing a fluid of selected viscosity and having a turbine rotatably mounted on a shaft in the interior. A braking cable is secured to a reel on the turbine shaft outside the cylinder and routed through a pulley to a braking block, which is slidably mounted on the cable between the trolley and the landing platform. The system may also may also include turbine blades of adjustable dimensions, so that the braking force may be controlled. The system may also include a counterweight suspended by a retraction cable which is coupled to the turbine shaft to rewind the braking cable on the reel for repeated use.

9 Claims, 13 Drawing Sheets

(56) References Cited

U.S. PATENT DOCUMENTS

| | | | |
|---|---|---|---|
| 4,961,385 | A | 10/1990 | Abouzakhm |
| 5,113,768 | A | 5/1992 | Brown |
| 5,224,425 | A | 7/1993 | Remington |
| 5,224,426 | A | 7/1993 | Rodunsky et al. |
| 5,378,214 | A | 1/1995 | Kreitenberg |
| 5,904,638 | A | 5/1999 | Habling et al. |
| 5,931,100 | A | 8/1999 | Sutton et al. |
| 6,363,858 | B1 | 4/2002 | Voirin |
| 6,666,773 | B1 | 12/2003 | Richardson |
| 7,172,538 | B2 | 2/2007 | Keiser |
| 7,381,137 | B2 | 6/2008 | Steele et al. |
| 7,404,360 | B2 | 7/2008 | Cylvick |
| 7,549,377 | B2 | 6/2009 | Pabst |
| 7,637,213 | B2 | 12/2009 | Cylvick |
| 2002/0162477 | A1 | 11/2002 | Palumbo |
| 2003/0066453 | A1 | 4/2003 | Cylvick |
| 2004/0198502 | A1 | 10/2004 | Richardson |
| 2006/0027134 | A1 | 2/2006 | Steele |
| 2006/0288901 | A1 | 12/2006 | Cylvick |
| 2007/0169660 | A1 | 7/2007 | Pabst |
| 2008/0121132 | A1 | 5/2008 | Cylvick |
| 2008/0202375 | A1 | 8/2008 | Quattlebaum |
| 2009/0049946 | A1 | 2/2009 | Buckman |
| 2009/0223406 | A1 | 9/2009 | Smith |
| 2009/0255436 | A1 | 10/2009 | Buckman |
| 2009/0266267 | A1 | 10/2009 | Moss |
| 2010/0243374 | A1 | 9/2010 | Boren et al. |

* cited by examiner

TROLLEY BRAKING SYSTEM

BACKGROUND

1. The Field of the Invention

The present invention is directed to a method and device for providing braking for a trolley traveling on a suspended cable or rope system.

2. The Background Art

Many prior art braking devices used to control the speed of trolleys provide braking force by contact between the cable or a pulley on the trolley with a friction surface on the trolley. The friction surface is therefore subject to wear and other conditions which may result in inconsistent and/or abrupt application of braking force. Also, it is desirable to ensure that the braking force is applied at the proper time for effectiveness and safety. Many such braking devices depend upon proper operation by the rider for satisfactory results.

BRIEF SUMMARY OF THE INVENTION

In view of the foregoing, in accordance with the invention as embodied and broadly described herein, a method and apparatus are disclosed for providing braking force to a trolley used to support a zipline rider which does not require the use of a friction surface on the trolley. Also, the braking device operates without the need for any action by the rider.

In selected embodiments, the braking system in accordance with the present invention may provide a braking force to a trolley as it travels along a cable suspending a rider by use of rotating turbine inside a chamber filled with a viscous fluid. The chamber containing the turbine may be mounted in a fixed orientation proximate the cable. In one embodiment, a braking block is positioned on the zipline cable in front of the trolley as it approaches the landing platform. The braking block is attached to a flexible braking cable which is wound on a cable reel. The cable reel is mounted on a shaft which also supports the turbine assembly inside the cylinder. As the trolley contacts the braking block, it forces the braking block forward towards the landing platform, and creates a tension force in the braking cable, which unwinds the braking cable from the cable reel, thus rotating the turbine assembly inside the cylinder against the viscous resistance provided by the fluid inside the cylinder.

The braking resistance provided to the braking block, and consequently to the trolley, results from the resistance to the turbine's rotation by the viscous fluid inside the cylinder as the braking cable is unwound from the cable reel, as the trolley travels forward towards the landing platform. Because the braking resistance is provided by the resistance to the turbine's rotation by the viscous fluid inside the cylinder, there is no frictional braking element which needs to be replaced or which is subject to failure.

In selected embodiments, the braking system in accordance with the present invention may also include mechanisms to vary the size of the turbines either manually or automatically, so that the applied braking force may be adjusted. Such mechanisms may comprise two-piece blades which slide relative to one another and may be manually positioned to produce the desired level of resistance. Alternatively, the plates may be held in position relative to one another by a spring biasing device which allows the outer plate to extend further from the turbine shaft as the centrifugal force from the rotational speed of the shaft increases to overcome the bias from the spring. This mechanism applies greater resistance to the trolley as it travels at higher speeds, and less resistance as the trolley speed is reduced.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

Figure 1:
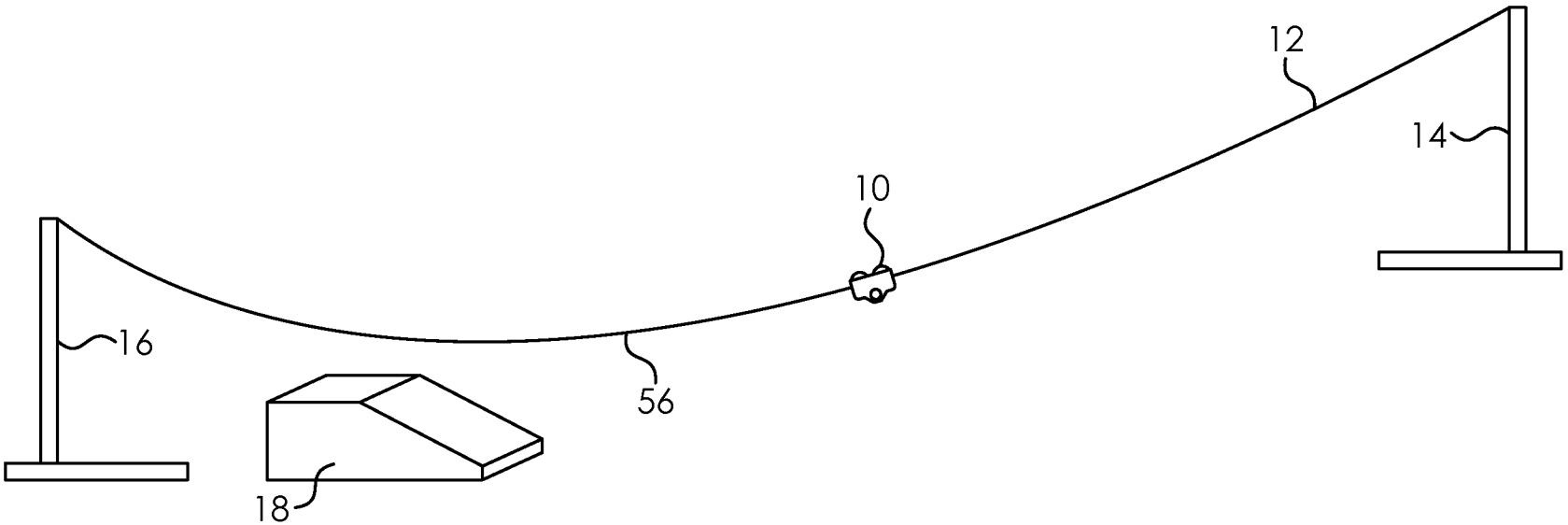
FIG. 1 is a schematic view of a typical use of a trolley on a suspended cable.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

While a suspended cable or rope may provide the basis for an amusement ride, other uses are also contemplated, including ski lifts, gondolas, aerial trams, and suspended cable evacuation systems, such as oil derrick evacuation systems.

Referring to FIG. 1, in a typical zipline configuration, a trolley 10 is used for travel along a stranded steel wire cable or fiber rope 12 held in suspension by two or more supports 14 and 16, e.g., trees, towers, or platforms. A first support 14 may secure one end of the cable 12 at a higher elevation than a second support 16 which secures the other end of the cable 12. Accordingly, the trolley 10 is secured to roll along the cable 12 to travel by force of gravity from the first, upper support 14 toward the second, lower support 16. As the trolley travels downhill, braking is not necessary. However, as the rider approaches the landing platform 18, such as at braking point 56, braking becomes necessary to reduce the rider's speed for safe arrival at the landing platform 18.

Figure 2:
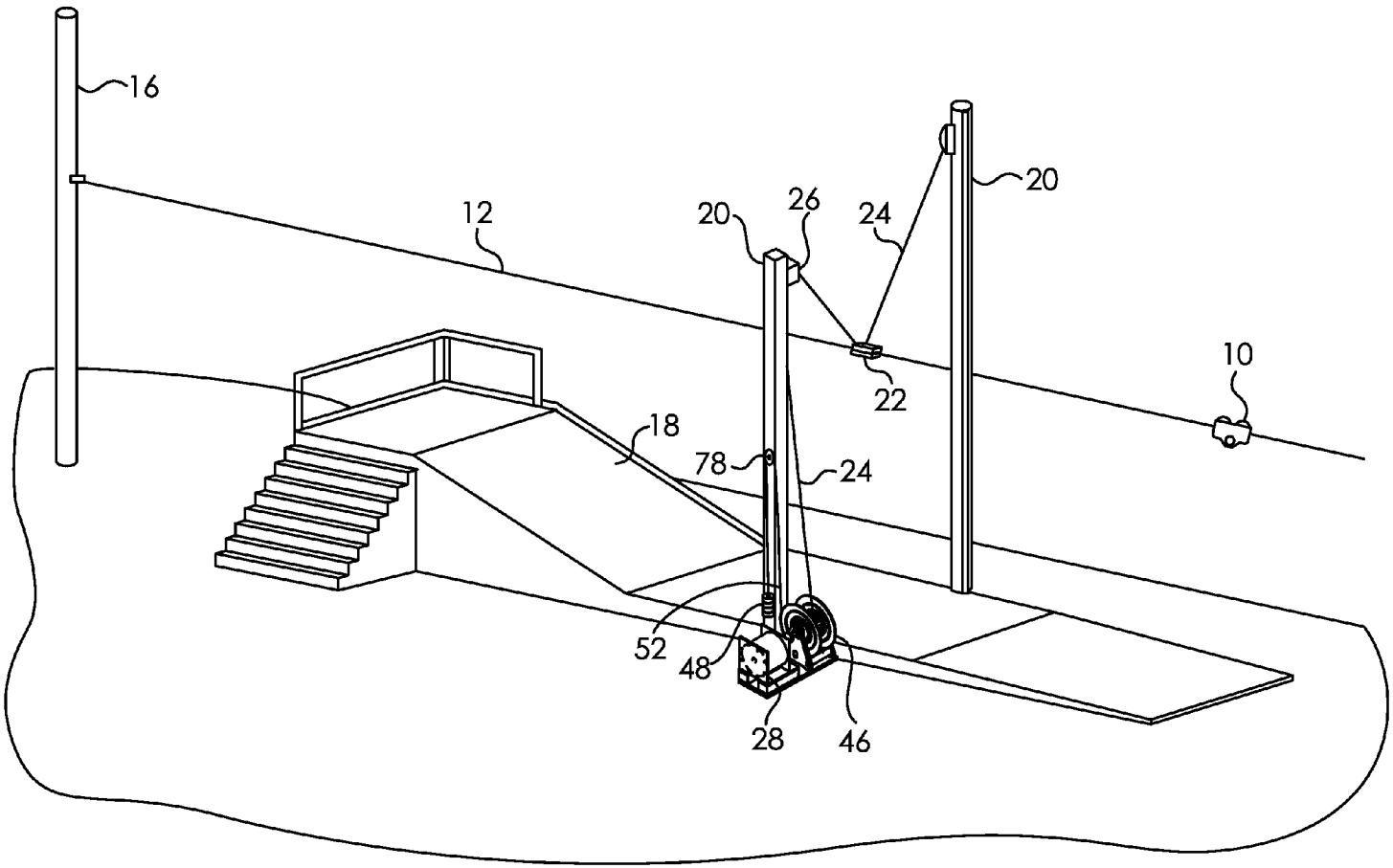
FIG. 2 is a perspective view of one embodiment of a trolley braking system in accordance with the present invention.

The present invention relates to a braking system to reduce the speed of zipline riders at a landing platform safely and effectively. As shown in FIG. 2, the braking system is preferably mounted at the front of the landing platform, and comprises a braking block 22 which is mounted on the same zipline cable 12 as the trolley 10 carrying the zipline rider.

Figure 3:
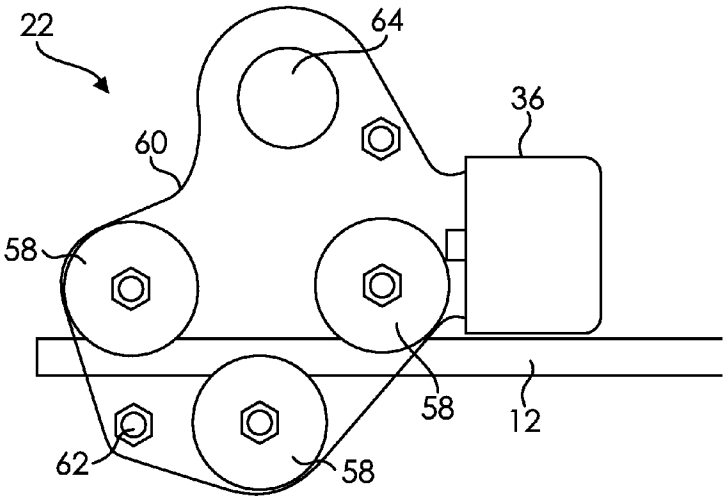
FIG. 3 is a side view of a braking block of one embodiment of a trolley braking system in accordance with the present invention.
Figure 4:
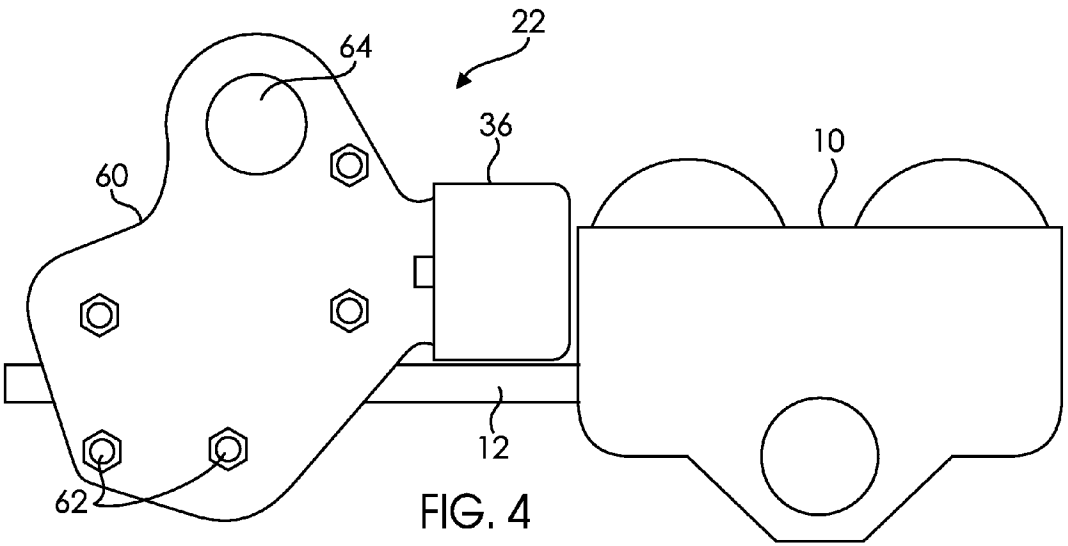
FIG. 4 is a side perspective cross-sectional view of a braking block of one embodiment of a trolley braking system in accordance with the present invention.
Figure 12:
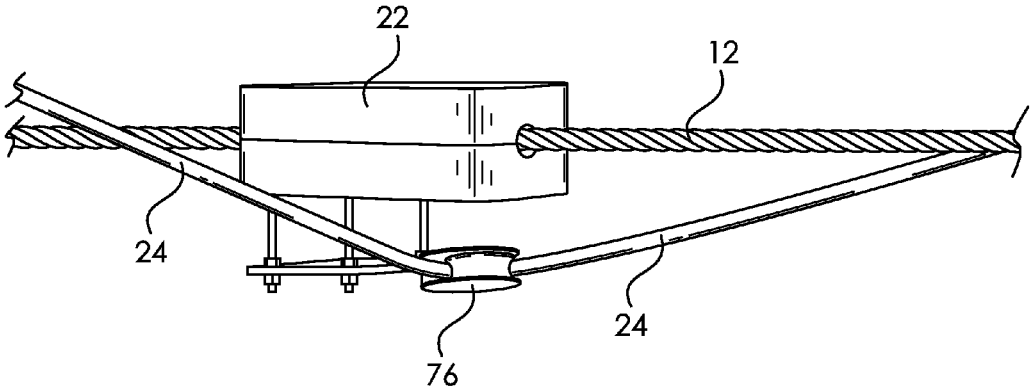
FIG. 12 is a side perspective view of a braking block of an alternative embodiment of a trolley braking system in accordance with the present invention.

As shown in FIGS. 3 and 4, the braking block 22 preferably includes one or more braking block plates 60 to which one or more pulleys 58 are rotatably mounted to roll along the zipline cable 12. Bolts 62 attached to braking block plate 60 may be used to mount the pulleys 58 or additional braking block plates 60 to the braking block plate 60. Openings 64 in the braking block plate 60 may be used to secure the braking cable 24 to braking block 22. However, any device capable of rolling or sliding along the cable 12 while restraining the trolley 10 can be used, such as a block of PVC, ABS, nylon, wood, or other suitable material configured with an opening or other mechanism to receive and slide along the cable 12. One such alternative configuration of a braking block 22 is illustrated in FIG. 12, which includes a braking cable pulley 76 to slidably mount the braking cable 24 to braking block 22. As shown in FIGS. 3 and 4, the braking block 22 preferably comprises an elastomeric bumper 36 made of urethane or other resilient material suitable to withstand and reduce the impact of the moving trolley 10 as it contacts the static braking block 22 in the ready position on the zipline cable 12 adjacent the support pole 20.

As shown in FIG. 2, the turbine housing 28 and the braking cable reel 46 are preferably mounted on a support pole 20, such as a utility pole, proximate to the landing platform 18, and offset laterally from the axis of the zipline cable 12 to avoid interference with the operation of the zipline. The braking cable 24 may be fixedly connected directly to the braking block 22, or as shown in FIGS. 2, 12 and 13-15, the braking cable 24 may be routed through a pulley or other rotatable or sliding connection and fixedly secured to a second support pole 20, preferably located symmetrically across the plane of the zipline cable 12 from the first support pole 20. The braking cable 24 may be made of stranded steel wire cable or fiber rope or other suitable material.

The braking cable reel 46 dispenses and retracts the braking cable 24 connected to the braking block 22. The braking cable 24 may comprise a static climbing rope, or stainless steel cable or other similar materials offering sufficient tensile strength and flexibility. The braking cable 24 is preferably routed through a pivoting pulley 26 secured to the support pole 20 proximate the turbine reel system to guide the braking cable 24 from the braking cable reel 46 to the braking block 22. As the angle between the braking cable 24 and the zipline cable 12 changes as the braking block 22 moves along the zipline cable 12 from the momentum of the rider on the trolley 10, the pivoting pulley 26 rotates on a vertical axis to maintain alignment with the braking block 22.

Figure 5:
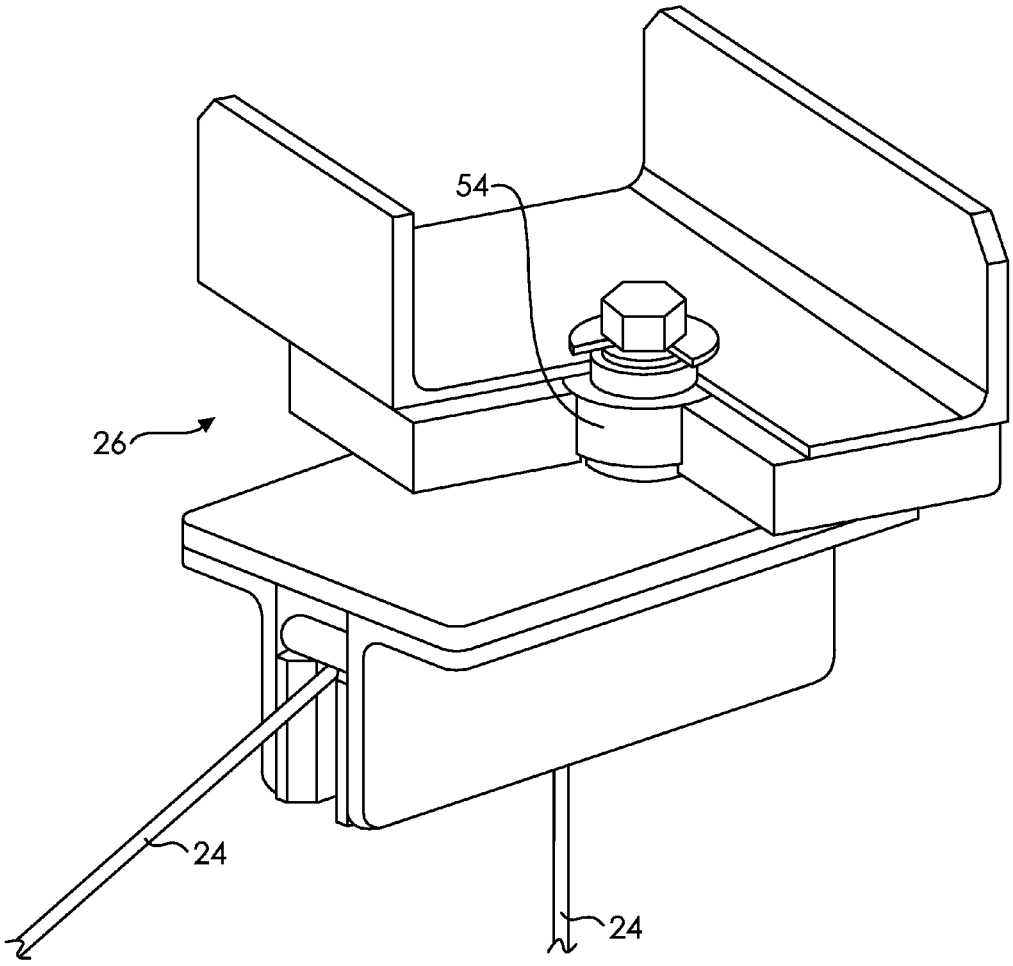
FIG. 5 is a side perspective view of a pivoting pulley assembly of one embodiment of a trolley braking system with a partial cross-sectional view of the spindle bearing in accordance with the present invention.
Figure 6:
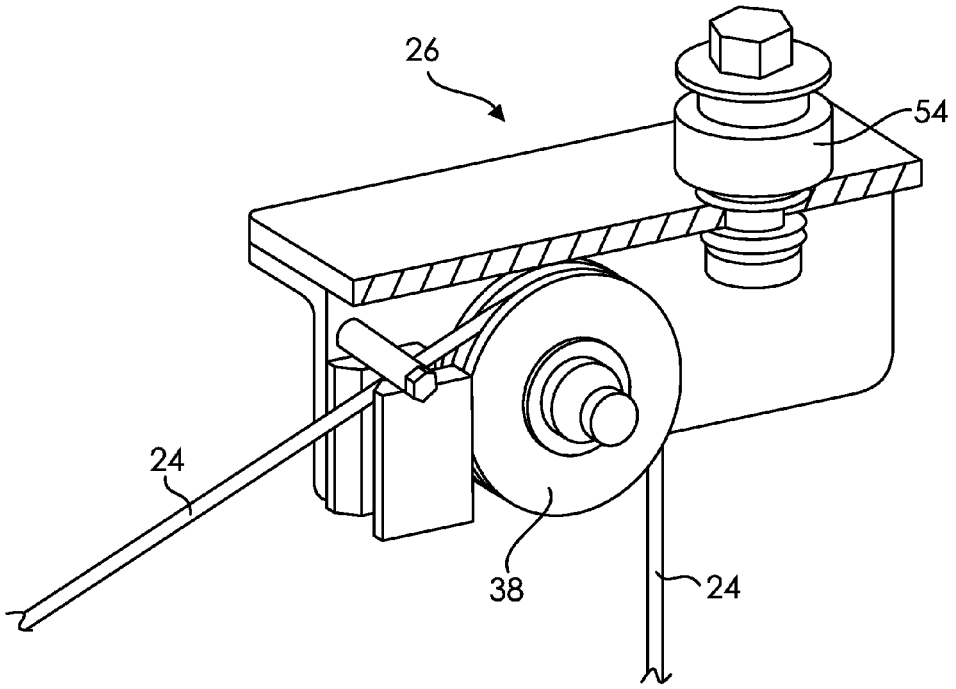
FIG. 6 is a side perspective cross-sectional view of a pivoting pulley assembly of one embodiment of a trolley braking system in accordance with the present invention.

As shown in FIGS. 2, 5 and 6, the braking cable 24 is attached to the first support pole 20 using a pivoting pulley 26, which is preferably mounted on the support pole 20 above the axis of the zipline cable 12. As shown in FIGS. 5 and 6, the pivoting pulley assembly 26 is configured to rotate freely on a vertical axis by use of a spindle bearing which allows the braking cable 24 to remain aligned in the direction of the pivoting pulley 26 as the braking block 22 is driven along the zipline cable 12 by the trolley 10 towards the landing platform 18. The laterally and vertically offset orientation of the pivoting pulley 26 from the zipline cable 12 provides a progressively increasing braking force as the rider proceeds down the zipline cable 12. As the direction of the braking cable 24 extending from the support pole 20 approaches the axis of the zipline cable 12, the magnitude of the resulting force from the braking cable 24 on the trolley in the direction along the axis of the zipline cable 12 also increases.

In one preferred embodiment of the present invention, the braking block 22 also provides additional braking resistance from friction applied to the cable 12 by the braking block bumper 36 as the braking line 24 provides increasing resistance to the braking block 22. As shown in FIGS. 3 and 4, the torque from the braking line 24 acting on the braking line attach point 64 positioned above the axis of the cable 12 produces a rotational movement around an axis perpendicular to the plane of the braking block plate 60, which causes the forward end of braking block 22 to rotate upwards and away from the cable 12 depending upon the angle between the braking cable 24 and the axis of the cable 12, and a corresponding downward force on the braking block bumper 36 against the upper surface of the cable 12. This force on the braking block bumper 36 against the upper surface of the cable 12 causes frictional drag on the braking block 22, and the trolley 10, which is trailing and forcing against the braking block bumper 36. The amount of frictional braking force applied from the resistance tension imparted upon the braking block 22 can be modified by adjusting the height of the braking line attach point 64 above the axis of the cable 12. As this height is increased, the frictional force imparted upon the cable 12 by the braking block bumper 36 commensurately increases.

Turbine Assembly

Figure 9:
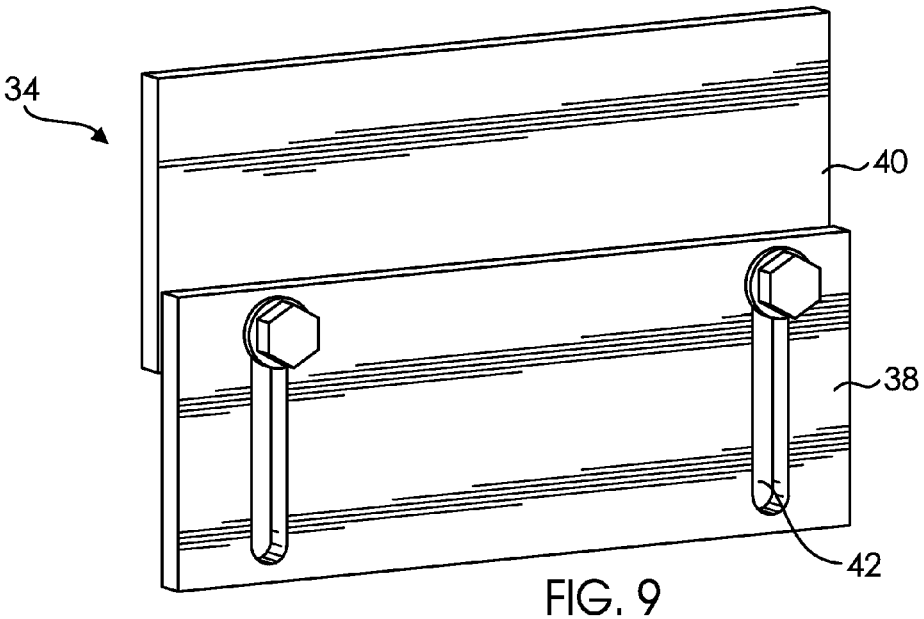
FIG. 9 is a perspective view of a turbine blade of one embodiment of a trolley braking system in accordance with the present invention.
Figure 10:
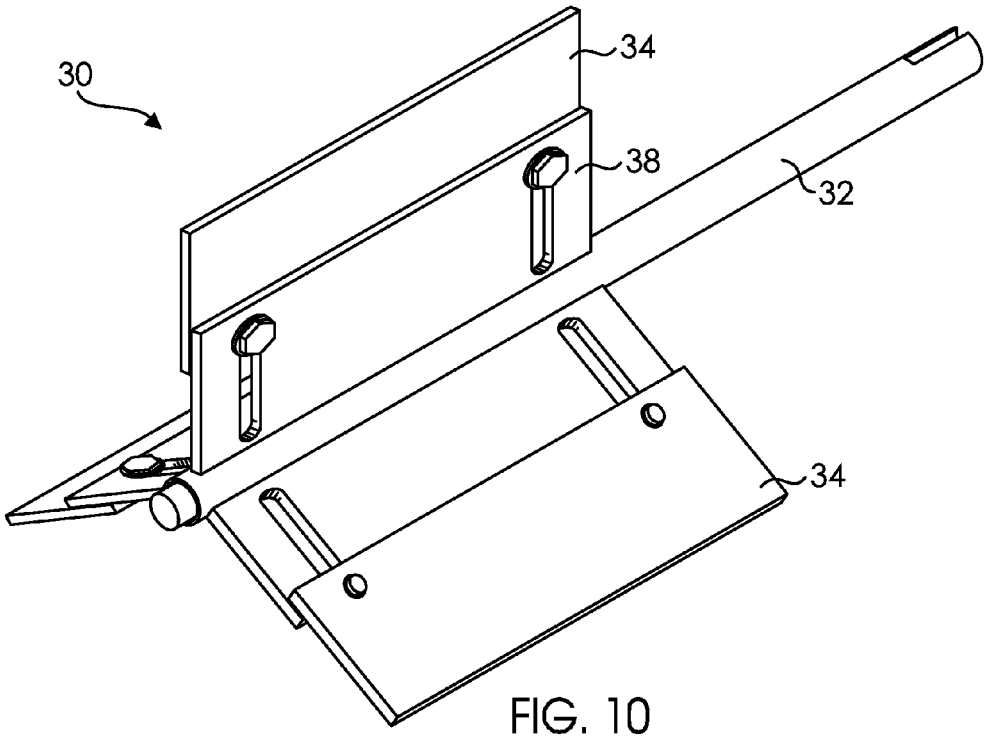
FIG. 10 is a perspective view of a turbine assembly of one embodiment of a trolley braking system in accordance with the present invention.

As shown in FIGS. 9 and 10 the turbine assembly 30 includes blades preferably made of steel or other robust material. The blades are preferably constructed of inner plates 38 and outer plates 40 of similar sizes. As shown in FIG. 10, the inner plate 38 is welded directly to the turbine shaft 32, and has a vertical slot 42 along both ends. The outer plate 40 has drilled and tapped holes that correspond to the position of the slots 42 in the inner plate 38. A bolt passes through each slot in the outer plate and threads into the corresponding hole of the inner plate 38 to secure the inner 38 and outer plates 40 as desired in position relative to one another. FIG. 9 illustrates one of the turbine blades 34 with the outer plate 40 in the fully extended position for maximum braking resistance. Nylon bushings may be placed between the bolt and the slot 42 to facilitate adjustment and prevent misalignment of the plates 38 and 40 during adjustment. FIG. 10 illustrates the turbine 30 with three inner plates 38 of the adjustable blades 34 welded to the shaft 32, each having a respective adjustable outer plate 40.

Because the force exerted at each point on the turbine blade increases as a function of the square of its velocity, and the velocity of a given point on a turbine blade 34 is proportional to its radius from the turbine shaft 32, the force applied to the turbine blades 34 and therefore the torsional resistance exerted by the turbine assembly 30 to the shaft 32 and braking cable reel 46 increases rapidly with increased turbine blade radius. Therefore, by adjusting the position of the outer plates 40, this system provides a wide range of braking resistance to accommodate various conditions among zipline orientations. The turbine blades 34 can thus be adjusted to accommodate variations in incoming rider speeds which results from differences in length, elevation change, weather conditions and the tension of each zipline.

Turbine Housing

Figure 7:
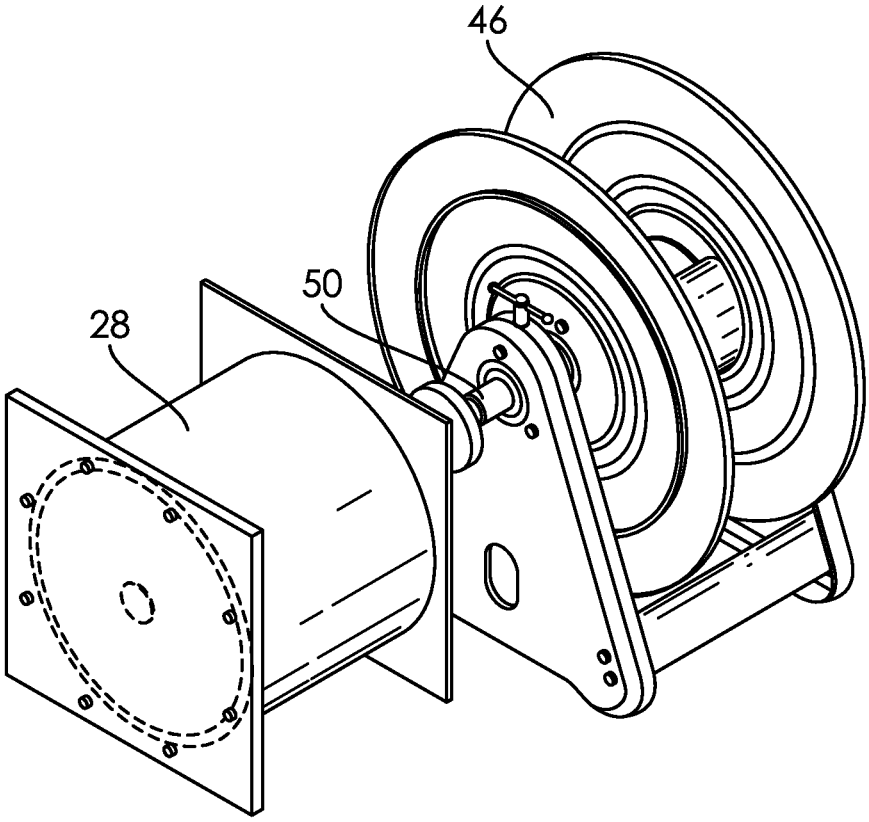
FIG. 7 is a perspective view of a turbine housing and braking cable reel assembly of one embodiment of a trolley braking system in accordance with the present invention.
Figure 8:
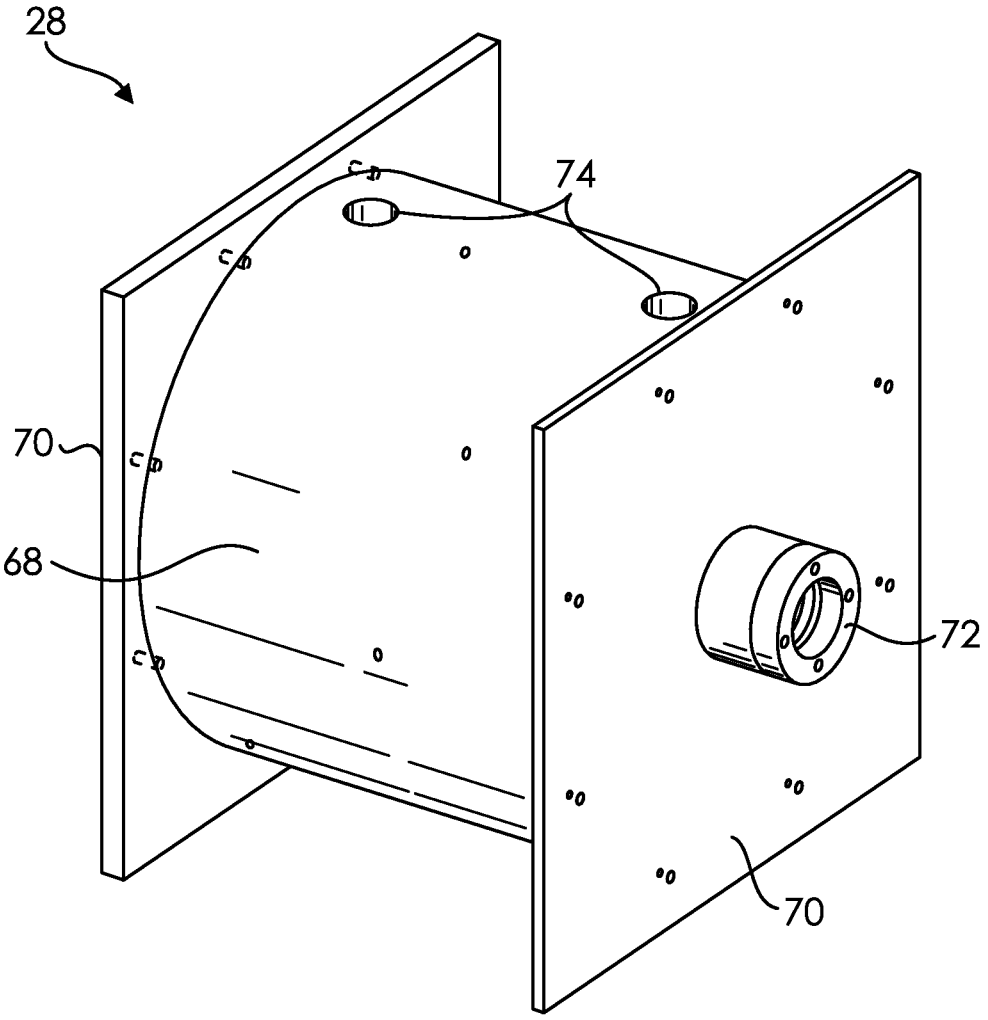
FIG. 8 is a perspective view of a turbine housing of one embodiment of a trolley braking system in accordance with the present invention.

A as shown in FIGS. 7 and 8, the turbine housing 28 is preferably an aluminum cylinder with two end caps 70, which secure the turbine 30 in a rotating mounting in the fluid. The turbine housing 28 may alternatively be made of other materials, such as a UV resistant plastic. At least one of the end caps 70 is preferably constructed of high density polycarbonate or similar transparent or translucent material to allow operators to visually examine the turbine blade positions and the fluid level inside the turbine housing 28. An oil resistant high temperature BCH rubber O ring is seated in each of the end caps 70, to form a seal to maintain the fluid inside the housing. As shown in FIG. 6 there are bearings 72 in each end of the cylinder to support the turbine shaft 32 in a rotational mounting. This turbine housing 28 is preferably fitted with a threaded opening 74 to allow refilling of the fluid as necessary. The openings 74 may be sealed with NPT square-headed plastic plugs.

The damping fluid may be selected upon a variety of factors, including density, cost and environmental friendliness. Since fluid drag is linearly dependent upon the density of the fluid and related to the velocity squared when the flow is turbulent, low viscosity facilitates turbulent flow which makes substances such as corn oil valuable in creating a speed-sensitive braking system. Additionally, the low cost and environmental friendliness of corn oil minimizes the consequences of accidental leaks or spills. Additionally the oil lubricates the moving parts inside the housing, minimizing wear of the components. Vegetable oil may be used in the turbine housing 28 due to its low cost, relatively low viscosity, medium density, and good lubricating properties. Its viscosity is, however, somewhat temperature dependent. Fluids with varying viscosities or densities can be selected based on the performance requirements in extreme temperatures.

Retraction System

Figure 11:
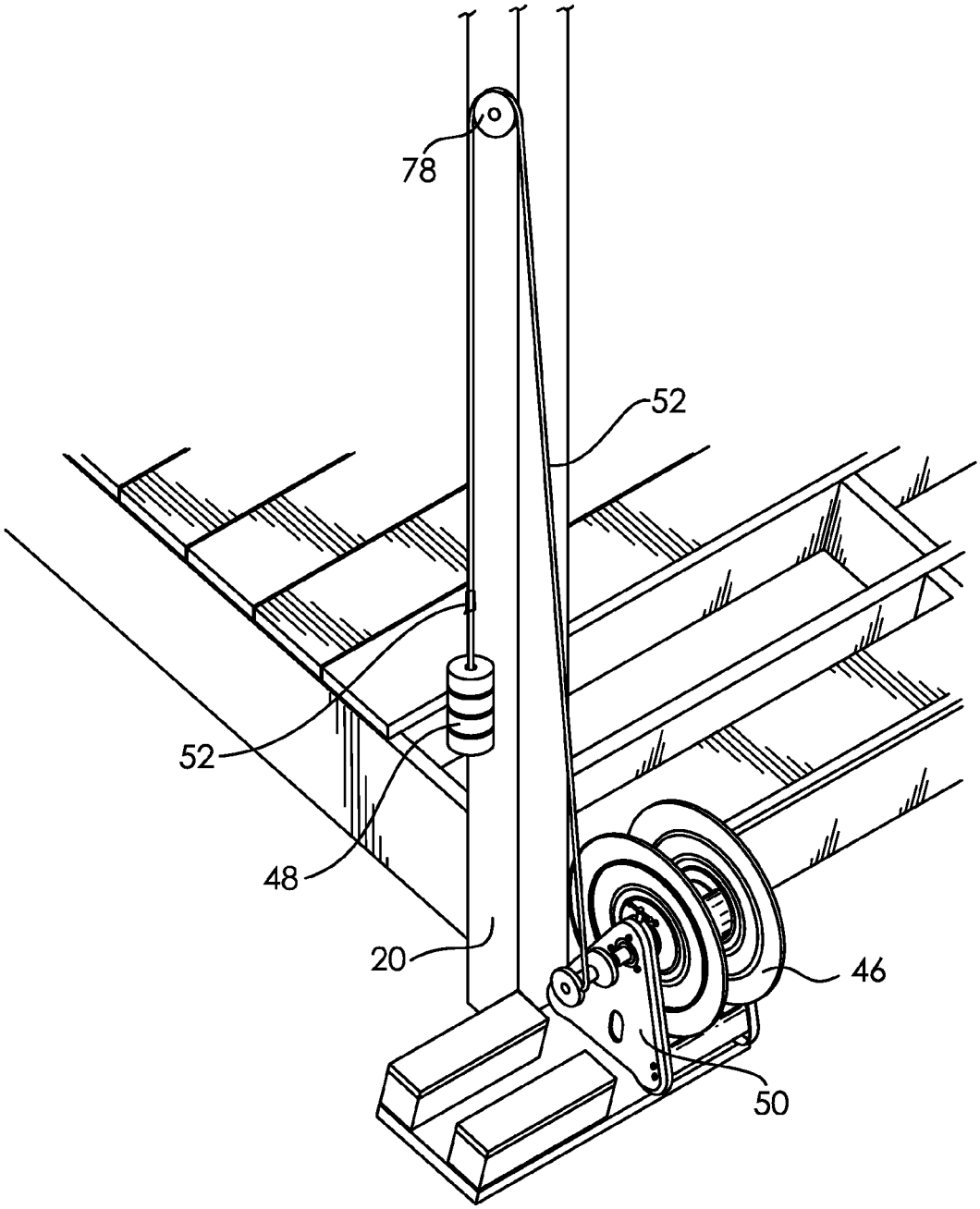
FIG. 11 is a perspective view of a turbine assembly of one embodiment of a trolley braking system in accordance with the present invention.

The system of the present invention may also include a retraction system to rewind the braking cable 24 on the cable reel 46 for repeated use. As shown in FIGS. 7 and 11, the retraction system comprises a counterweight 48 suspended by a retraction cable or rope 52 which is routed over a retraction rope pulley 78 and wound on a retraction reel 50 that is coupled to the turbine shaft 32 to rewind the braking cable 24 on the cable reel 46 for repeated use with successively arriving riders. This automatic retraction system returns the braking block 22 to its starting position once the rider has been disconnected from the trolley 10 on the zipline 12. The retraction reel 50 is rotatably mounted on a shaft that is connected to the turbine shaft 32 and mounted on to shaft collars on either side.

As shown in FIGS. 7 and 11, the retraction reel 50 is preferably mounted to the turbine shaft 32, which is connected to the shaft of the rotatably mounted braking cable reel 46. The connection is preferably made with a roller coupling or other type of flexible torque coupling which will accommodate minor misalignment between the shafts, while maintaining the necessary torque connection between the turbine shaft 32 and the shaft of the braking cable reel 46.

As shown in FIG. 11, the counterweight 48 used to unwind the retraction reel 50 may preferably comprise an adjustable stack of weights which may be contained within a vertical cylindrical enclosure, such as a PVC pipe mounted (not shown) on the support pole 20 or set directly into the ground. The weight required for a typical installation may be approximately 25 pounds, and can preferably be adjusted in one-pound increments, depending on the retraction force needed to reset the braking block 22 for a given zipline. As the braking block 22 travels along the zipline cable 12, the counterweight 48 is raised. The retraction rope 52 exits the top of the PVC pipe and is redirected to the retraction reel by retraction rope pulley 78 mounted to the support pole 20. The retraction rope 52 is wound around the retraction reel 50 in the opposite direction that the braking cable 24 is wound around the braking cable reel 46. Thus, the retraction rope 52 is unwound when the braking cable 24 is wound, and vice versa. As the retraction rope 52 is wound during the braking process, the counterweight 48 rises. Additionally, because the counterweight provides a small, nearly constant torque to the retraction reel 50, riders can walk up the landing ramp after braking with relative ease. Once the rider is detached from the trolley 10 line, the force exerted by the counterweight 48 on the retraction rope 52 is sufficient to unwind the retraction rope 52, thereby rewinding the braking cable 24 around the braking cable reel 46, and automatically returning the braking block 22 to its initial position.

In this manner, after the rider has dismounted the trolley 10 to the landing platform 18, the trolley 10 is removed from the zipline cable 12, and the gravitational force on the counterweight 48 creates a tension farce on the retraction rope 52, which rotates the cable reel backwards, to create a tension force on the braking cable 24, drawing the braking block 22 backwards on the zipline cable 12 to the ready position adjacent the support pole 20. Thus, the braking block 22 is in position on the zipline cable 12 to receive and safely reduce the speed of the next zipline rider to arrive at the landing platform 18. Also, as the direction of the braking cable 24 extending from the support pole 20 approaches the axis of the zipline cable 12, the magnitude of the resulting torsional force from the braking cable 24 on the trolley 10 in the direction along the axis of the zipline cable 12 also increases.

The present system may additionally incorporate a backup braking mechanism, such as a mountain bike disc brake mounted on the turbine shaft 32 or shaft of the braking cable reel 46 to provide additional braking force in the event of unusually demanding conditions, such as a day when riders are experiencing a strong tailwind, or a turbine failure.

Accordingly, in one preferred embodiment, due to the combined effects the mechanical advantages of the pulley on the braking block and the lateral and vertical offset orientation of the pivoting pulley 26 from the axis of the zipline cable 12, the braking block 22 may travel a distance along the zipline cable 12 which may be up to approximately three times the distance traveled by the braking cable 24 as it unreels from the cable reel 46. As can be appreciated by one of ordinary skill in the art, other arrangements of pulley blocks and braking cables and diameters of cable reel may provide different ranges of mechanical advantage between the turbine assembly 30 and the braking block 22.

Additionally or alternatively, the turbine blades 34 in accordance with the present invention may include a spring-loaded outer plate 40 that is configured to be restrained in the innermost position. When the tensile force on the braking cable 24 reaches a certain level, the centrifugal force in the outer plate 40 caused by the rotational speed of the turbine 30 overcomes the resistance of the spring and causes the outer plate 40 to extend to a greater diameter, consequently generating more rotational resistance to the braking cable reel 46, thus creating greater braking force imparted from the braking block 22 to the trolley 10.

Figure 13:
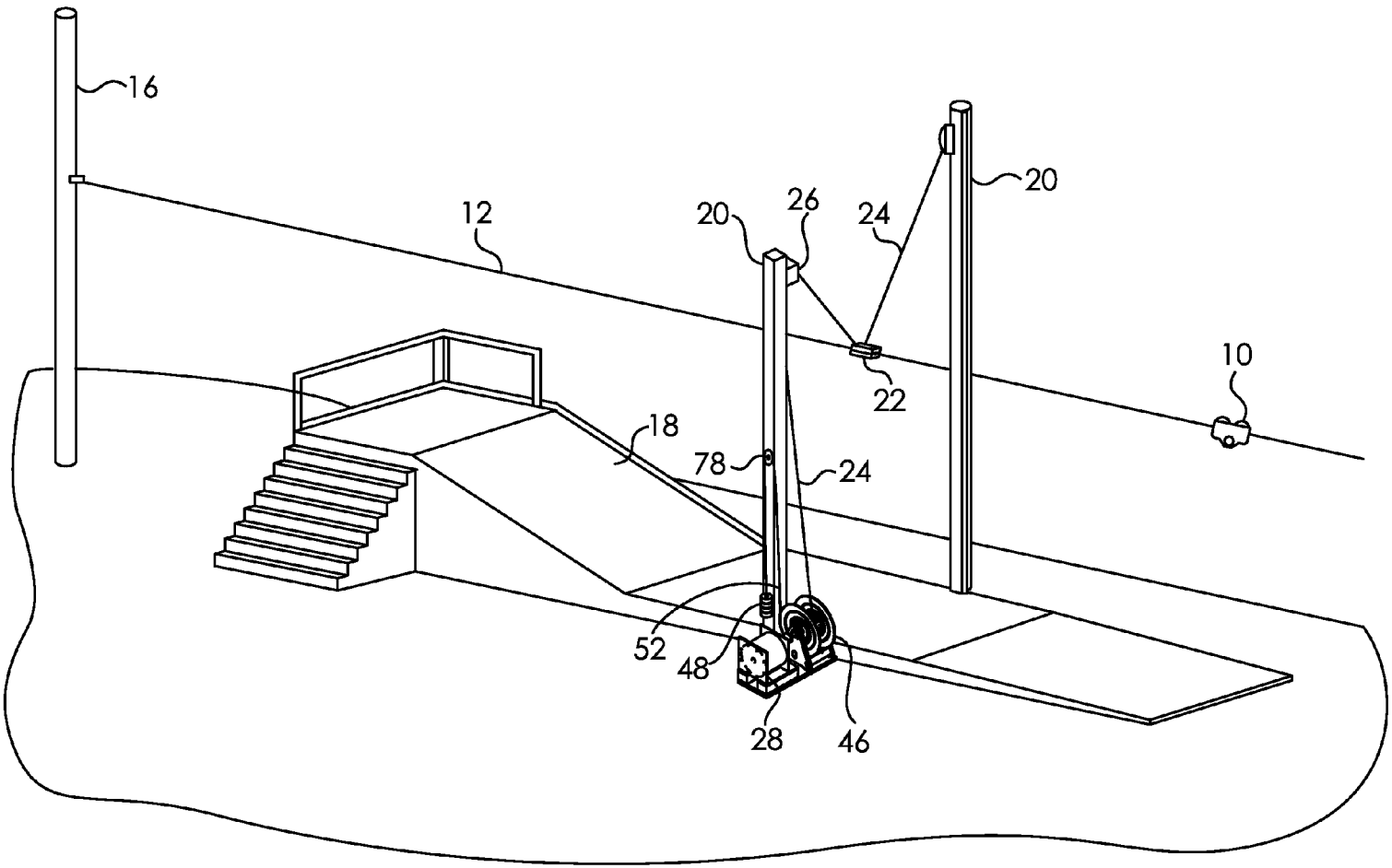
FIGS. 13-15 are side perspective views illustrating the operation of one embodiment of a trolley braking system in accordance with the present invention.
Figure 14:
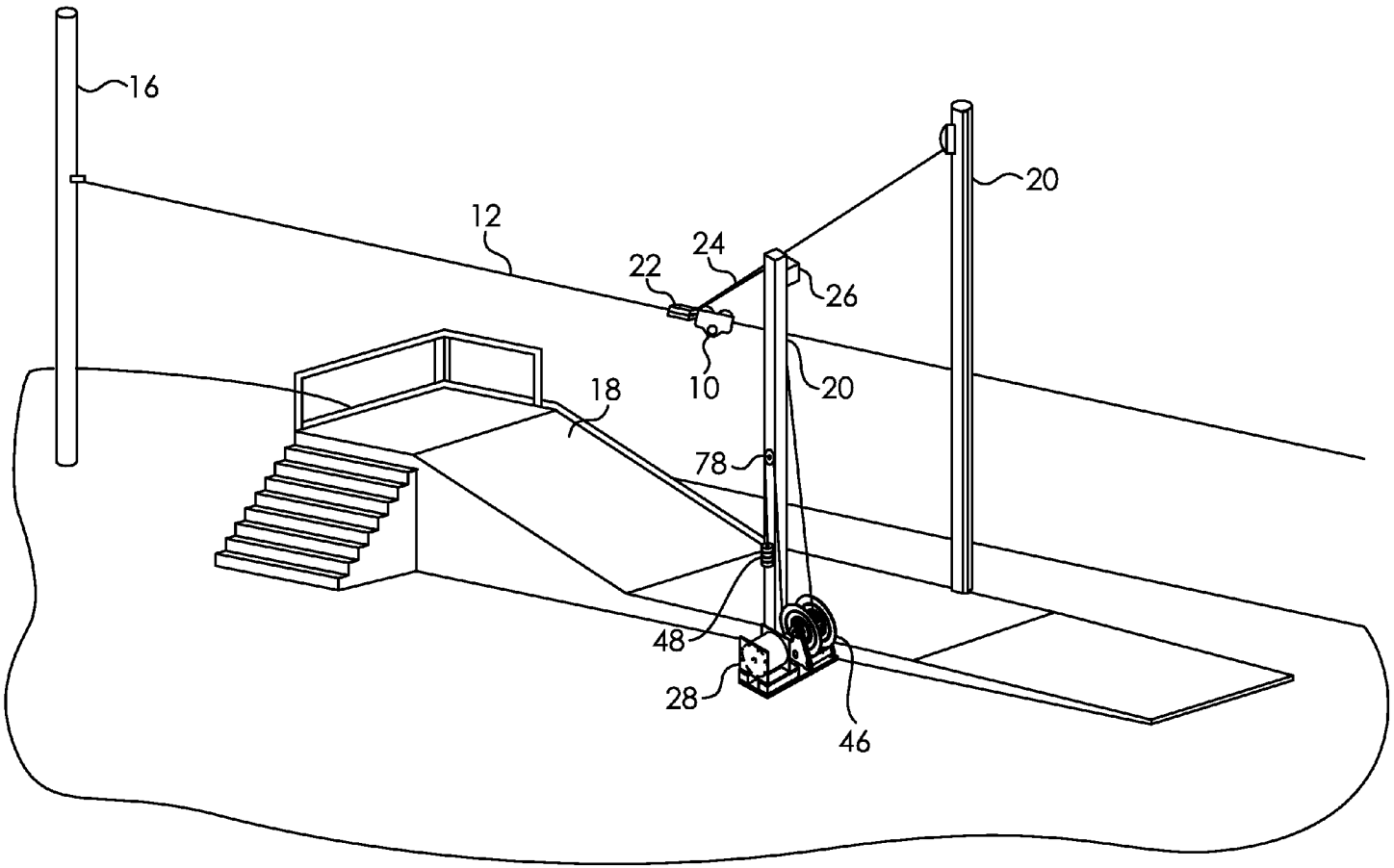
Figure 15:
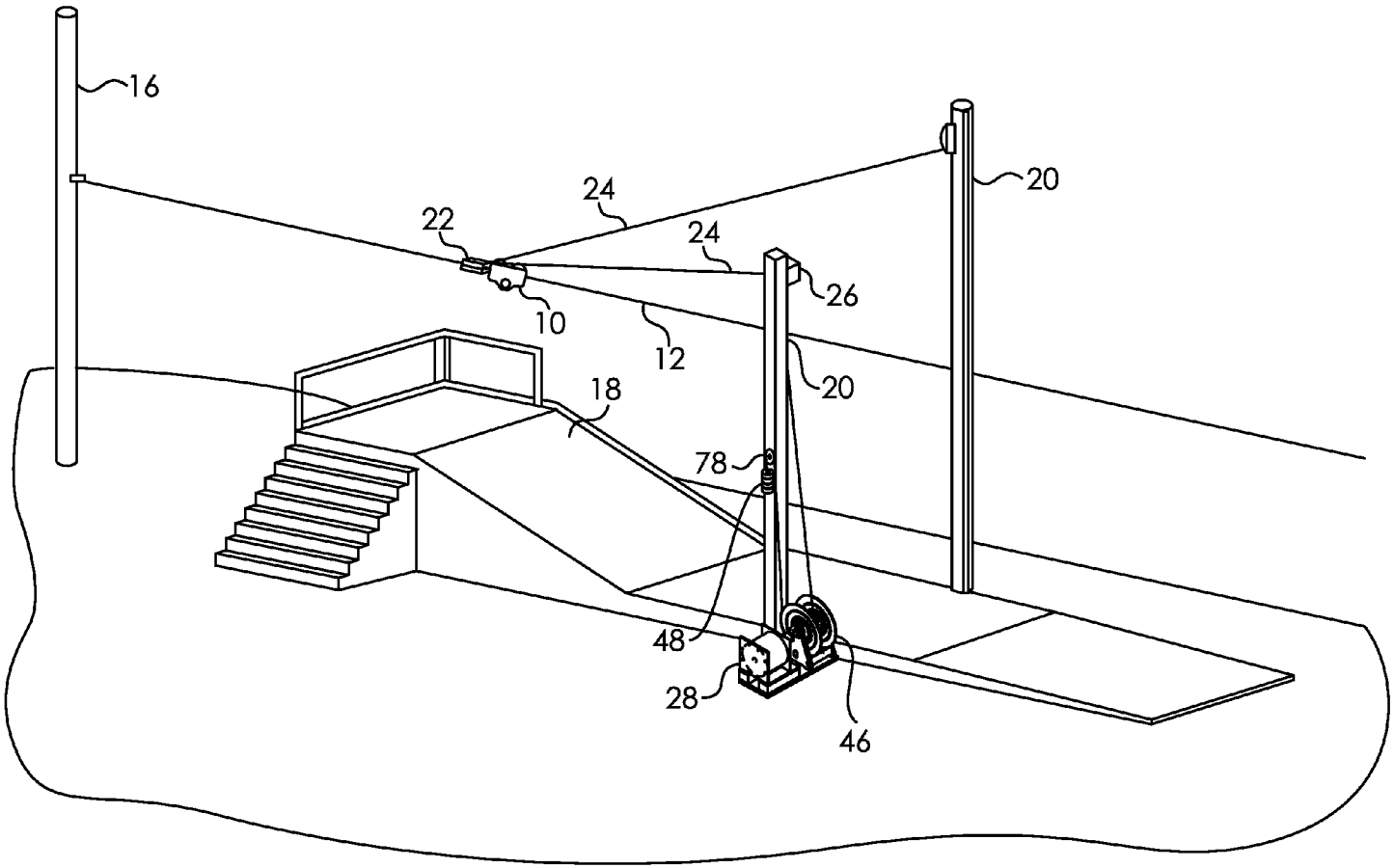

The operation of a braking system according to a preferred embodiment of the present invention is illustrated in FIGS. 13-15. As shown in FIG. 13 the braking block 22 is mounted on the cable 12 near the support pole 20, upon which is mounted the turbine housing 28 and braking cable reel 46. As illustrated in FIG. 14, as the trolley 10 contacts the braking block 22 on the cable 12, it forces the braking block 22 along the cable 12 towards the landing platform 18, and creates a tensile force in braking cable 24. This tensile force in the braking cable 24 exerts an rotational force on the braking cable reel 46 and the turbine assembly 30 through the turbine shaft 32, thus rotating the turbine assembly 30 inside the turbine housing 28 against the viscous resistance provided by the fluid, which resists the forward motion of the braking block 22 and the trolley 10 which is traveling behind it on cable 12. Also, as the braking block 22 travels along the zipline cable 12, the counterweight 48 is raised as the retraction rope 52 is wound around the retraction reel 50 in the opposite direction that the braking cable 24 is wound around the braking cable reel 46.

As shown in FIG. 15, as the braking block 22 proceeds to a point above the landing platform 18, the braking cable 24 extends and dissipates the momentum and speed of the rider. As the braking block 22 travels further along the zipline cable 12, the counterweight 48 is raised higher as the retraction rope 52 is wound further around the retraction reel 50. As the rider comes to rest at the landing platform 18, the tensile force on braking cable 24 is dissipated so that the trolley 10 may be removed from the cable 12, and the braking block 22 is free to travel on the cable 12, and is pulled back to its starting position adjacent the support pole 20 due to the weight of the counterweight 48 acting through the braking cable 24.

In summary, a preferred embodiment of the present invention comprises a braking system for a trolley which suspends and transports a rider on a cable to a landing platform which includes a closed vessel containing a fluid and having a turbine rotatably mounted in the interior of the vessel upon a shaft, a reel mounted to the shaft, a braking cable having one end wound on the reel, and a braking block connected to the braking cable and slidably mounted on the cable between the trolley and the landing platform, the braking block connected to the braking cable.

In another preferred embodiment, the present invention comprises an apparatus for transporting a rider between a point and a landing platform which includes a cable; a plurality of supports configured to suspend the cable between the point and the landing platform; a trolley for suspending and transporting the rider supported by a harness on the cable; and a braking system comprising a closed vessel containing a fluid and having a turbine rotatably mounted in the interior of the vessel upon a shaft, a reel mounted to the shaft, a braking cable having one end wound on the reel, and a braking block connected to the braking cable and slidably mounted on the cable between the trolley and the landing platform.

In another preferred embodiment, the present invention comprises a method for transporting a rider between a point and a landing platform comprising the steps of providing a cable, and a plurality of supports configured to suspend the cable between the point and the landing platform; suspending the rider by a harness attached to a trolley on the cable; providing a braking system comprising a closed vessel containing a fluid and having a turbine rotatably mounted in the interior of the vessel upon a shaft, a reel mounted to the shaft, a braking cable having one end wound on the reel, and a braking block connected to the braking cable and slidably mounted on the cable between the trolley and the landing platform; and positioning the braking block between the trolley and the landing platform.

These examples are provided for the purposes of illustration and the present invention is not limited to them.

What is claimed is:

1. A braking system for a trolley which suspends and transports a rider on a cable to a landing platform comprising:
- a closed vessel containing a fluid and having a turbine rotatably mounted in the interior of the vessel upon a shaft;
- a reel mounted to the shaft;
- a braking cable having one end wound on the reel; and
- a braking block connected to the braking cable and slidably mounted on the cable between the trolley and the landing platform, wherein the braking cable is slidably routed through the braking block and fixedly connected to a support on the opposite side of the cable from the reel.

2. The braking system of claim 1 wherein the braking cable is routed through an opening in the braking block.

3. The braking system of claim 1 wherein the braking cable is routed through a pulley secured to the braking block.

4. An apparatus for transporting a rider between a point and a landing platform comprising:
- a cable:
- a plurality of supports configured to suspend the cable between the point and the landing platform;
- a trolley for suspending and transporting the rider supported by a harness on the cable; and
- a braking system comprising:
  - a closed vessel containing a fluid and having a turbine rotatably mounted in the interior of the vessel upon a shaft;
  - a reel mounted to the shaft;
  - a braking cable having one end wound on the reel; and
  - a braking block connected to the braking cable and slidably mounted on the cable between the trolley and the landing platform, wherein the braking cable is slidably routed through the braking block and fixedly connected to a support on the opposite side of the cable from the reel.

5. The apparatus of claim 4 wherein the braking cable is routed through an opening in the braking block.

6. The apparatus of claim 4 wherein the braking cable is routed through a pulley secured to the braking block.

7. A method for transporting a rider between a point and a landing platform comprising the steps of:
- providing a cable, and a plurality of supports configured to suspend the cable between the point and the landing platform;
- suspending the rider by a harness attached to a trolley on the cable;
- providing a braking system comprising:
  - a closed vessel containing a fluid and having a turbine rotatably mounted in the interior of the vessel upon a shaft;
  - a reel mounted to the shaft;
  - a braking cable having one end wound on the reel; and
  - a braking block connected to the braking cable and slidably mounted on the cable between the trolley and the landing platform, wherein the braking cable is slidably routed through the braking block and fixedly connected to a support on the opposite side of the cable from the reel; and positioning the braking block between the trolley and the landing platform.

8. The apparatus of claim 7 wherein the braking cable is routed through an opening in the braking block.

9. The apparatus of claim 7 wherein the braking cable is routed through a pulley secured to the braking block.

* * * * *